US012790765B2

(12) United States Patent
Baek

(10) Patent No.: US 12,790,765 B2
(45) Date of Patent: Nov. 10, 2026

(54) MODULAR FLOORING WITH IMPROVED GRIP

(71) Applicant: Gerflor, Villeurbanne (FR)

(72) Inventor: Hyung Min Baek, Salt Lake City, UT (US)

(73) Assignee: GERFLOR, Saint Paul Trois Chateaux (FR)

( * ) Notice: Subject to any disclaimer, the term of this patent is extended or adjusted under 35 U.S.C. 154(b) by 0 days.

(21) Appl. No.: 17/515,449

(22) Filed: Oct. 30, 2021

(65) Prior Publication Data

US 2022/0136178 A1 May 5, 2022

Related U.S. Application Data

(60) Provisional application No. 63/108,200, filed on Oct. 30, 2020.

(51) Int. Cl.

| | |
|---|---|
| ***E01C 5/20*** | (2006.01) |
| ***E01C 13/04*** | (2006.01) |
| ***E04F 15/10*** | (2006.01) |

(52) U.S. Cl.

CPC ..... *E01C 5/20* (2013.01); *E01C 13/045* (2013.01); *E04F 15/10* (2013.01); *E01C 2201/12* (2013.01)

(58) Field of Classification Search

CPC ... E04F 15/10; E04F 15/02172; E04F 15/105; E04F 2201/021; E04F 15/22; E04F 2201/0146; E01C 5/20; E01C 5/22; E01C 2201/12; E01C 2201/10; E01C 2201/207

See application file for complete search history.

(56) References Cited

U.S. PATENT DOCUMENTS

| | | | | |
|---|---|---|---|---|
| 3,438,312 | A | 4/1969 | Becker et al. | |
| 3,909,996 | A | 10/1975 | Ettlinger et al. | |
| 4,008,548 | A | 2/1977 | Leclerc | |
| 4,167,599 | A | 9/1979 | Nissinen | |
| D255,744 | S | 7/1980 | Dekko | |
| 4,226,064 | A * | 10/1980 | Kraayenhof ..... | A01K 1/015 428/44 |
| 4,436,799 | A | 3/1984 | Evans et al. | |
| D274,588 | S | 7/1984 | Swanson et al. | |
| 4,930,286 | A | 6/1990 | Kotler | |

(Continued)

FOREIGN PATENT DOCUMENTS

| | | |
|---|---|---|
| CN | 102231998 | 11/2011 |
| CN | 207211629 U | 4/2018 |
| CN | 101517175 | 9/2018 |

OTHER PUBLICATIONS

International Search Report for Serial No. PCT/IB2021/000769 dated Mar. 9, 2022, 6 pages, United States.

*Primary Examiner* — Brian E Glessner

(74) *Attorney, Agent, or Firm* — Thorpe North & Western, LLP; Garron M. Hobson; Kurt H. Hendricks

(57) ABSTRACT

A modular tile is disclosed configured to interlock with multiple tiles to form a modular floor covering over a floor. The tile includes improved grip and bounce characteristics. The tile may include an upper contact surface having rib with top edges that are sharp. Protrusions may extend from the upper contact surface to provide grip and increase ball bounce performance. The tile may be made of a composite of rigid plastic and rubber to improper bounce characteristics, including by increasing the degree to which the tile conforms with a subfloor.

18 Claims, 8 Drawing Sheets

(56) References Cited

U.S. PATENT DOCUMENTS

| | | | | |
|---|---|---|---|---|
| 5,705,250 | A * | 1/1998 | Hudson, Jr. | B32B 7/12 52/309.3 |
| 7,571,573 | B2 | 8/2009 | Moller | |
| 8,225,566 | B2 * | 7/2012 | Prevost | E01C 13/08 52/302.1 |
| 8,535,785 | B2 * | 9/2013 | Masanek, Jr. | E01C 13/045 428/140 |
| 8,769,904 | B1 * | 7/2014 | Brandt | E04C 2/46 52/177 |
| 2005/0223664 | A1 * | 10/2005 | Gardner | D06N 7/0055 52/235 |
| 2006/0177619 | A1 * | 8/2006 | Kessler | E04F 15/10 428/44 |
| 2007/0284035 | A1 * | 12/2007 | Nevison | E01C 11/24 156/279 |
| 2009/0235605 | A1 * | 9/2009 | Haney | E01C 13/045 52/741.1 |
| 2009/0239036 | A1 * | 9/2009 | Becker | B32B 38/06 428/143 |
| 2011/0000149 | A1 * | 1/2011 | Beyder | E04F 19/045 52/287.1 |
| 2014/0363621 | A1 * | 12/2014 | Ngo | B27B 9/02 52/309.1 |
| 2015/0252563 | A1 | 9/2015 | Cerny et al. | |
| 2018/0327980 | A1 * | 11/2018 | Penland, Jr. | E01C 5/16 |

* cited by examiner

PGT

PGP

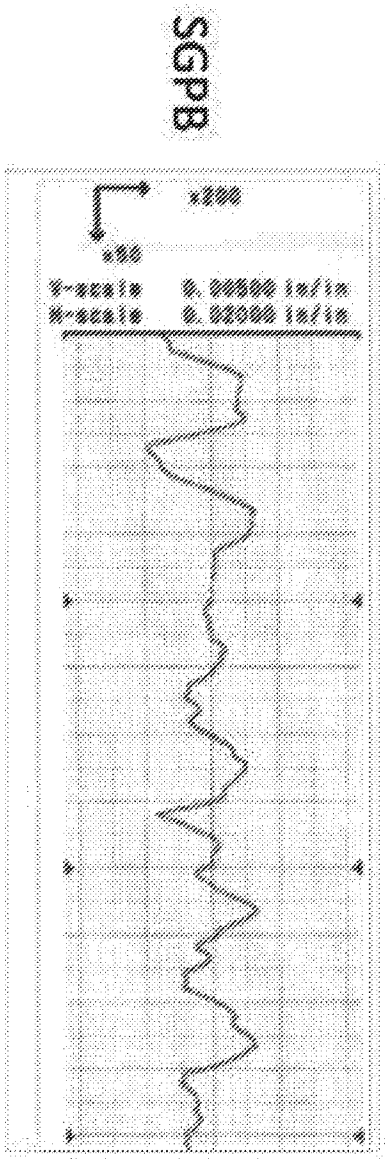

*Fig. 9*

All dimensions in μ inches

| | PGT (PG) | PGP (PG+) | SGPB | Definition |
|---|---|---|---|---|
| Ra | 309.64 | 483.93 | 545.55 | Arithmetic mean of the absolute values of vertical deviation from the mean line |
| Rq | 385.65 | 595.01 | 657.79 | Square root of the arithmetic mean of the square of the vertical deviation from a reference line |
| Rz | 1672.85 | 1942.38 | 2503.69 | Distance between the averages of five highest peaks and the five lowest valleys |
| Rp | 678.11 | 828.21 | 1110.1 | Distance between the highest peak and the mean line |
| Rv | 994.74 | 1114.17 | 1393.59 | Distance between the mean line and the lowest valley |
| Rt | 2975.05 | 3019.72 | 3188.5 | Distance between the highest peak and the lowest valley |
| RGN | N10 | N10 | N11 | Roughness Grade Number internationally adopted |

*Fig. 10*

MODULAR FLOORING WITH IMPROVED GRIP

PRIORITY CLAIM

The present application claims priority to U.S. Provisional Application Ser. No. 63/108,200 filed on Oct. 30, 2020 entitled "Modular Flooring with Improved Grip" which is incorporated herein by reference in its entirety.

FIELD

The present invention relates generally to modular synthetic tiles for use as a floor covering, and more particularly to a modular synthetic tile in which elements are designed and configured to enhance the performance characteristics of the floor.

BACKGROUND

Numerous types of flooring have been used to create playing areas for such sports as basketball, volleyball, tennis and pickleball, as well as for other purposes. These flooring assemblies include concrete, asphalt, acrylic, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps. Wood floors, such as are used for many basketball courts, have an appropriate amount of give to avoid such injuries. The wood floors, however, are expensive to install and require continued maintenance to keep them in good condition. Acrylic floors, such as for hard courts for racquet sports, provide ideal ball bounce properties, but require maintenance and provide no "give" during use, resulting in injuries.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. No. Des. 274,588; U.S. Pat. Nos. 3,438,312; 3,909,996; 4,436,799; 4,008,548; 4,167,599; 4,226,064 and U.S. Pat. No. Des. 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood. However, there is a need for synthetic flooring to have qualities optimized for specific uses that are better than qualities found in current synthetic flooring materials. In particular, current synthetic flooring does not include characteristics optimized for tennis and pickleball, including ball bounce properties.

Therefore, it would be advantageous to provide a flooring tile that includes characteristics advantageous for tennis and pickleball.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 9 illustrates a surface roughness chart for a modular tile according to the present invention;

FIG. 10 illustrates a chart of testing data comparing the relatively smooth synthetic tiles referenced in FIGS. 7-8.

DESCRIPTION OF EMBODIMENTS

Figure 1:
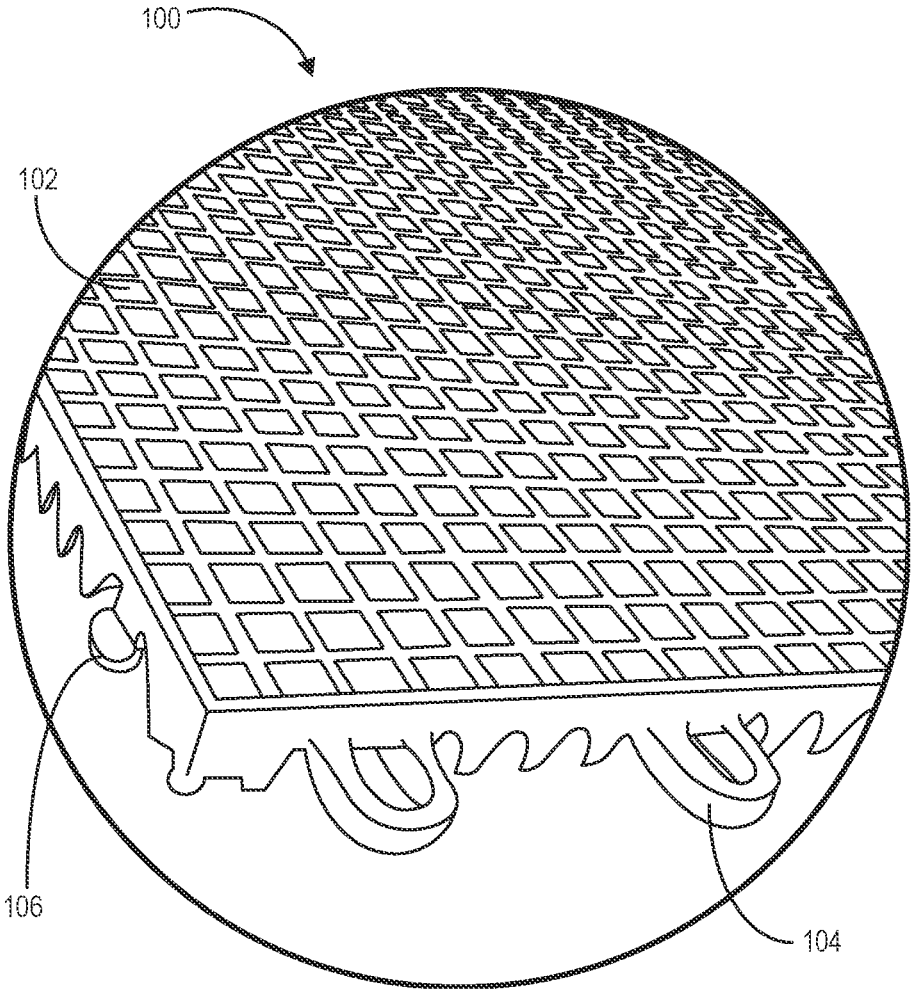
FIG. 1 illustrates a partial perspective view of a modular tile according to an embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present disclosure describes a method and system for improving the traction between a shoe and the surface of a modular tile, while also increasing the shock absorption. More particularly, the method and system relate to improving ball behavior on the surface of synthetic floor tiles.

Traditionally, synthetic floor tiles may suffer from inconsistent or inadequate rebounding or bouncing of balls, such as tennis balls or pickleballs, as compared to traditional acrylic hard courts for tennis and pickleball. For example, synthetic floor tiles may suffer from skipping of balls, where the ball skips across the surface of the tile in a way that is not consistent with an expected rebound or bounce. Also, traditional synthetic floor tiles may produce inconsistent in/out angles for balls, for example where the angle of the ball's trajectory leaving the surface (the out angle) is different not consistent with the angle of the ball's trajectory as it approaches the surface (the in angle). Another deficiency of traditional synthetic floor tiles is that they may include dead spots, particularly at the center of the tile where the tile does not have consistent contact with the subfloor or surface below the tile, which results in inconsistent bounce.

In some instances, the smooth surface of existing modular tiles limits their capability to slow down the ball. This may result in a trajectory post-bounce that is straight or almost straight, whereas acrylic court surface give an arc-like trajectory.

According to aspects of the present disclosure, a synthetic modular tile is provided that may include a surface or top geometry, such as an embossing or protrusions on the upper contact surface of the tile. As described herein, the protrusions on the upper contact surface of the tile improve the grip of the ball. The tile also includes an upper contact surface which includes a number of contact flats or ribs along the upper contact surface that form a geometry with other contact flats or ribs, such as a square or a diamond. In some embodiments of the technology, the radius of the top surface ribs is minimal, for example less than 0.005 inch, to increase the grip of a ball on the upper contact surface.

In some embodiments, the composition of the tile is a mix of rigid plastic and rubber. The upper contact surface may be rigid, contributing to bounce of a ball on the tile. Meanwhile, the rubber component of the composition gives the tile characteristics that allow it to conform to any unevenness of the subsurface. By conforming to unevenness of the subfloor or subsurface, dead zones can be avoided, for example on the center of the tile.

The top ribs can have a thickness ranging from 2.5 mm to 5.0 mm depending on the preferred size of the opening in between. For example, the rib thickness tends to be smaller for outdoor tiles in order to drain water more efficiently but be thicker (or some case a solid top) for indoor tiles with no water drainage concerns.

As discussed herein, the upper contact surface may include grains or protrusions on the ribs or contact flats. In some aspects, the protrusions form a series of irregular-shaped protrusions that have typical widths of 0.1-0.3 mm and lengths of 0.3 mm-1.0 mm. In some aspects, the protrusions stand 0.01-0.10 mm proud of the top surface in order to provide slip resistance to the end user's shoes, and more importantly the ball, such as a plastic pickleball. The grains or protrusions may be applied to the plastic injection molding tool via acid etching or laser.

The minimal radius on the edge of the ribs or contact flats is also built into the plastic injection molding tool, and is designed and configured to leave very little radius to each top edge of the ribs or contact flats. By having a sharper edge, the slip resistance between the upper contact surface and the ball increases, which contributes to a more natural rebound or bounce of ball as compared to traditional synthetic tiles.

As will be apparent herein, there are various advantages of the improved synthetic tile of the present disclosure. Adding rubber to the composition reduces dead spots caused by uneven subfloors and unintended gaps between the tile and the subfloor because the tile is more flexible and allowed to bend and conform to the subservice. Ball bounce and consistency are increased by reducing the gaps between the tile and the subfloor. Moreover, adding rubber makes the synthetic tiles more elastic, which itself increases the overall bounce of a ball. Other benefits will be discussed and understood from the present disclosure.

Figure 2:
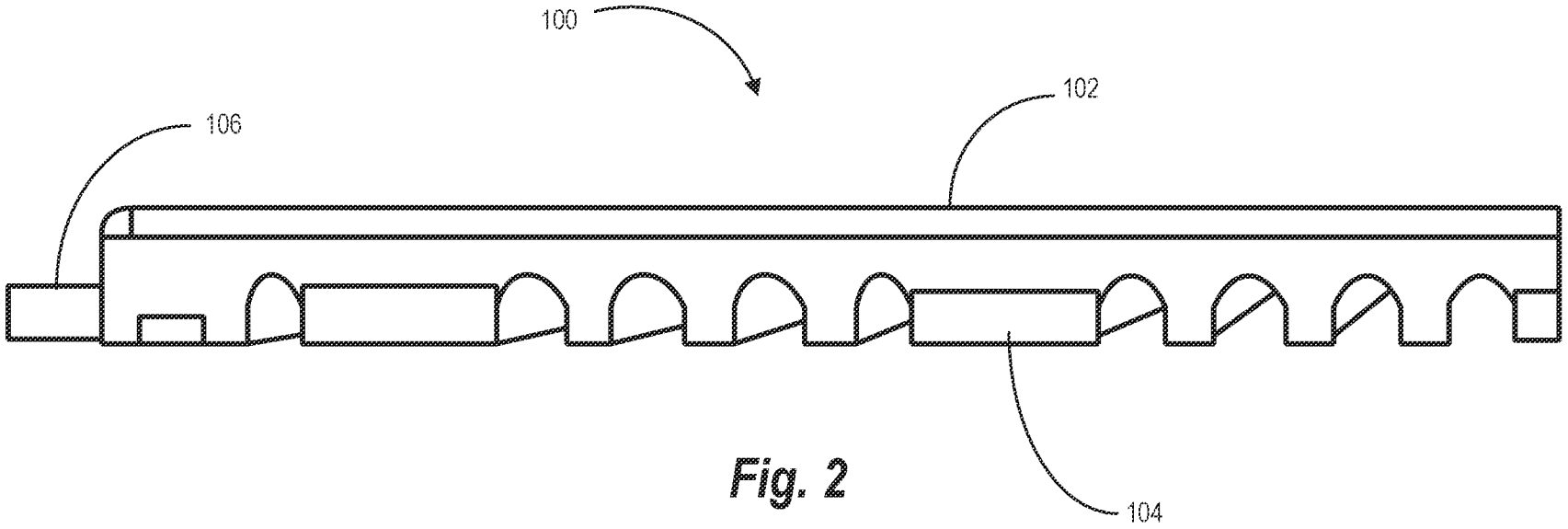
FIG. 2 illustrates a partial profile view of the modular tile of FIG. 1.

Now with specific reference to the drawings, FIGS. 1-2 illustrate a modular tile 100 configured to be interconnected into a tile array to form a floor covering over a floor surface, such as a tennis court, basketball court, pickleball court or any other suitable floor surface. The modular tiles 100 are configured to interconnect using a plurality of loop connectors 104 and a plurality of pin connectors 106. As is known, the loop and pin connectors 104 and 106 provide a secure fit between the tiles, while also providing lateral forgiveness. Tile 100 also includes a top surface or upper contact surface 102, which includes contact flats or ribs 103. As shown, the ribs may form an opening, or an array of openings, which may be square, diamond-shaped, or some other geometry.

Figure 3:
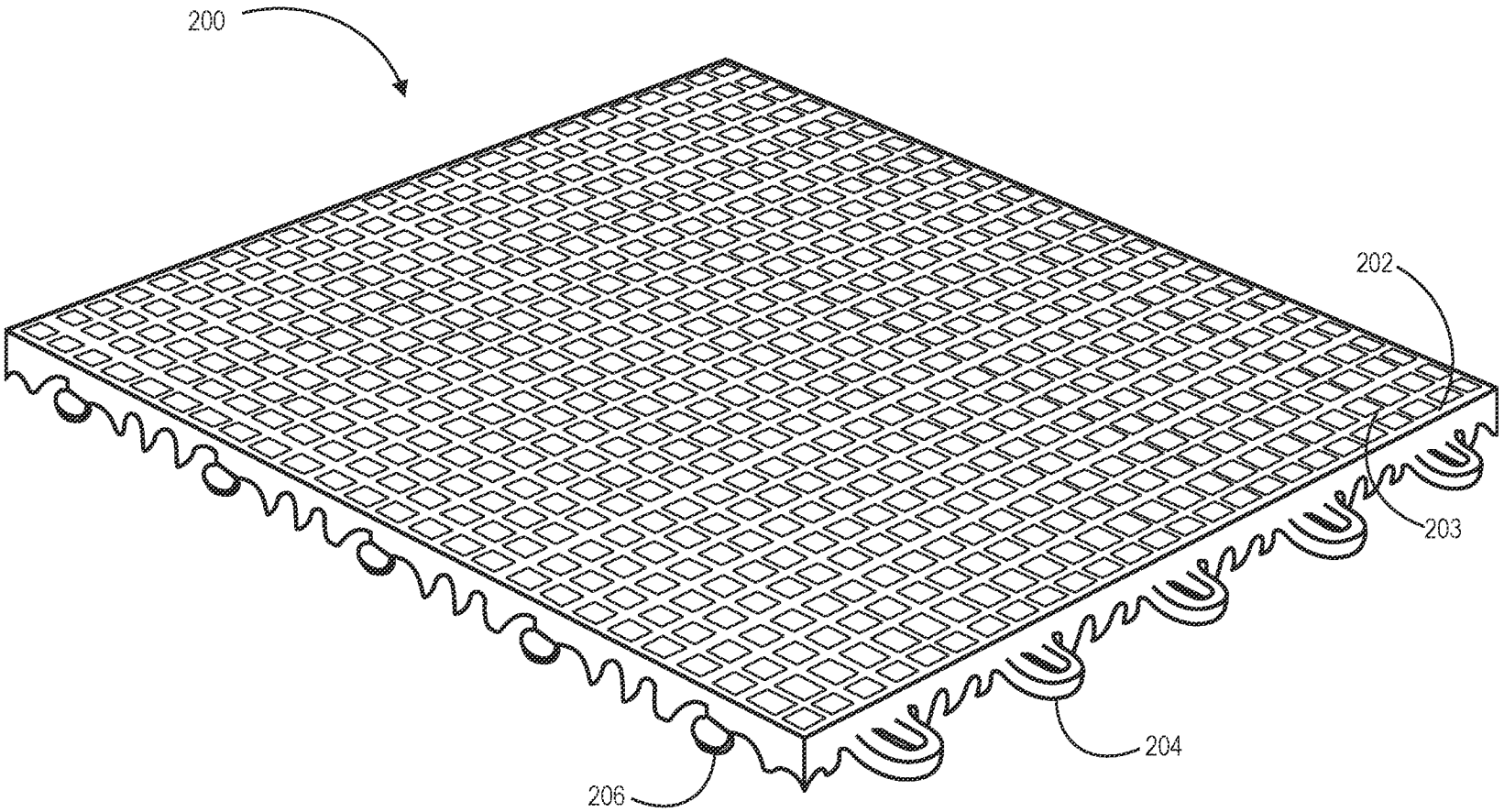
FIG. 3 illustrates an perspective view of an improved modular tile according to an embodiment of the present invention.
Figure 4:
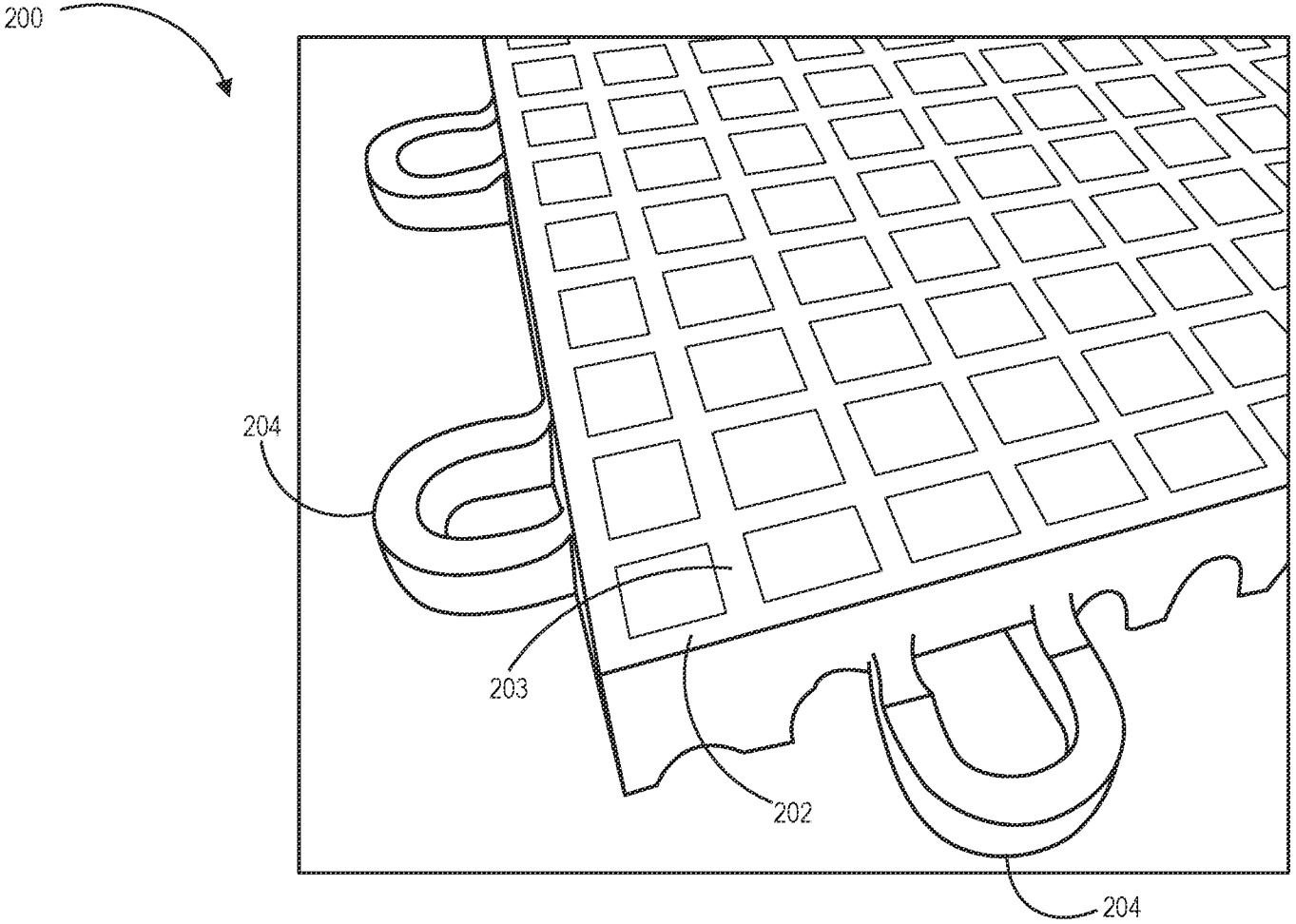
FIG. 4 illustrates an enlarged perspective view of the tile in FIG. 3.
Figure 5:
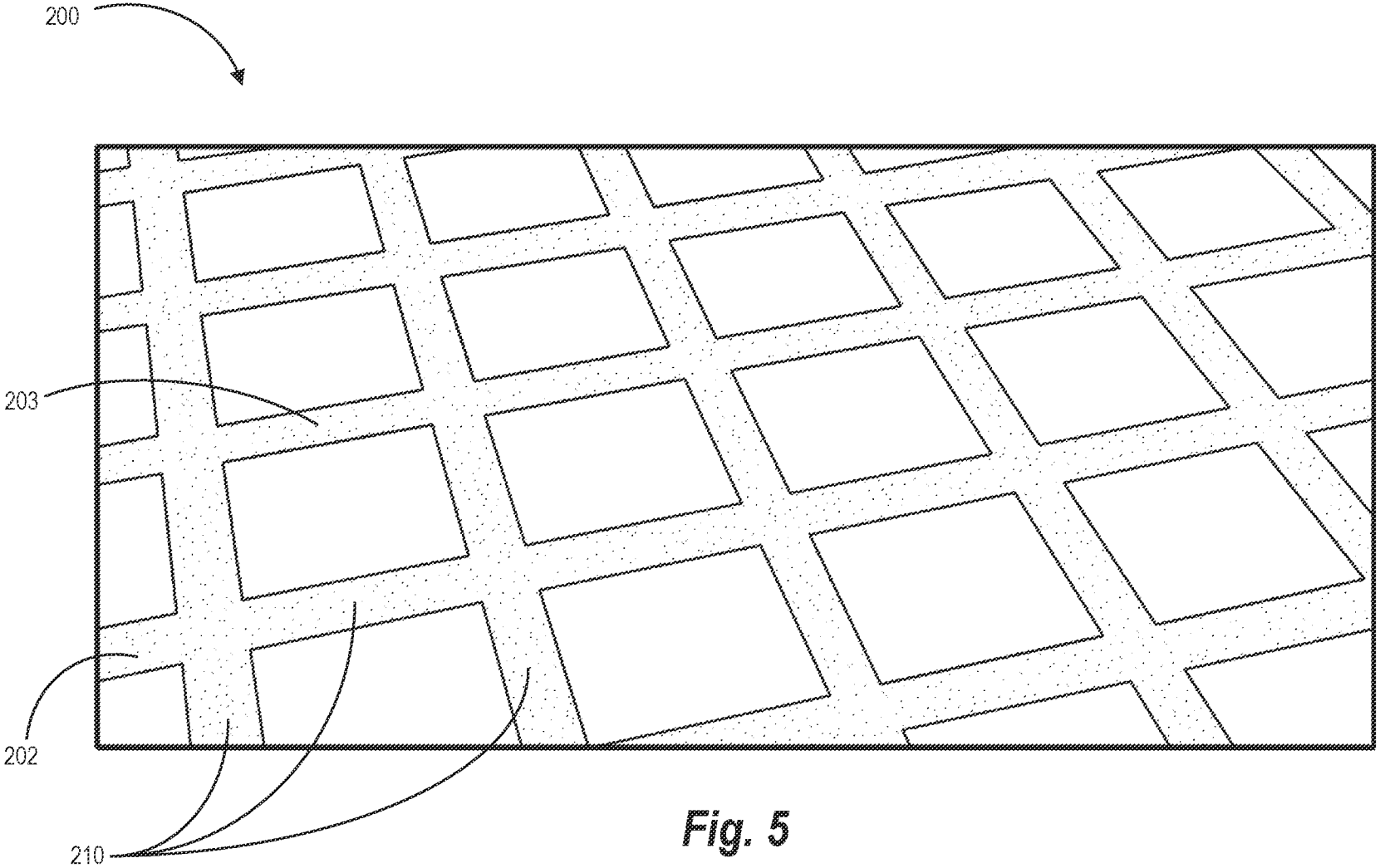
FIG. 5 illustrates a close up perspective view of the contact surface of the tile in FIG. 3.

FIGS. 3-5 show another tile 200 according to aspects of the present technology. Tile 200 includes a top surface or upper contact surface 202, which also includes contact flats or ribs 203 forming an array of openings. Ribs 203 include a sharp upper edge on either side, which may be the result of a minimal radius, such as less than 0.005 inches. The sharp radius provides additional grip, as discussed herein, including better bounce qualities for balls. Tile 200 also includes a plurality of protrusions 210 or grains on the upper contact surface 202. Protrusions 210 may be formed on the contact flat 203 of the upper contact surface 202.

Protrusions 210 may take any size or shape suitable for providing roughness which improves the grip of the top surface. As disused herein, protrusions 210 may extend above the top or upper contact surface 202, and may be formed of the same material as the tile, or of a different material or coating.

Tile 200 may be formed of a material that combines rigid plastic and rubber to achieve a rigid top surface with some flexibility within the tile, as discussed herein. The the material properties of the tile 200, the protrusions 210 on the upper contact surface 202, and the sharp upper edge of the contact flats 203 may combine to provide improved bounce characteristics, including improved grip.

Figure 6:
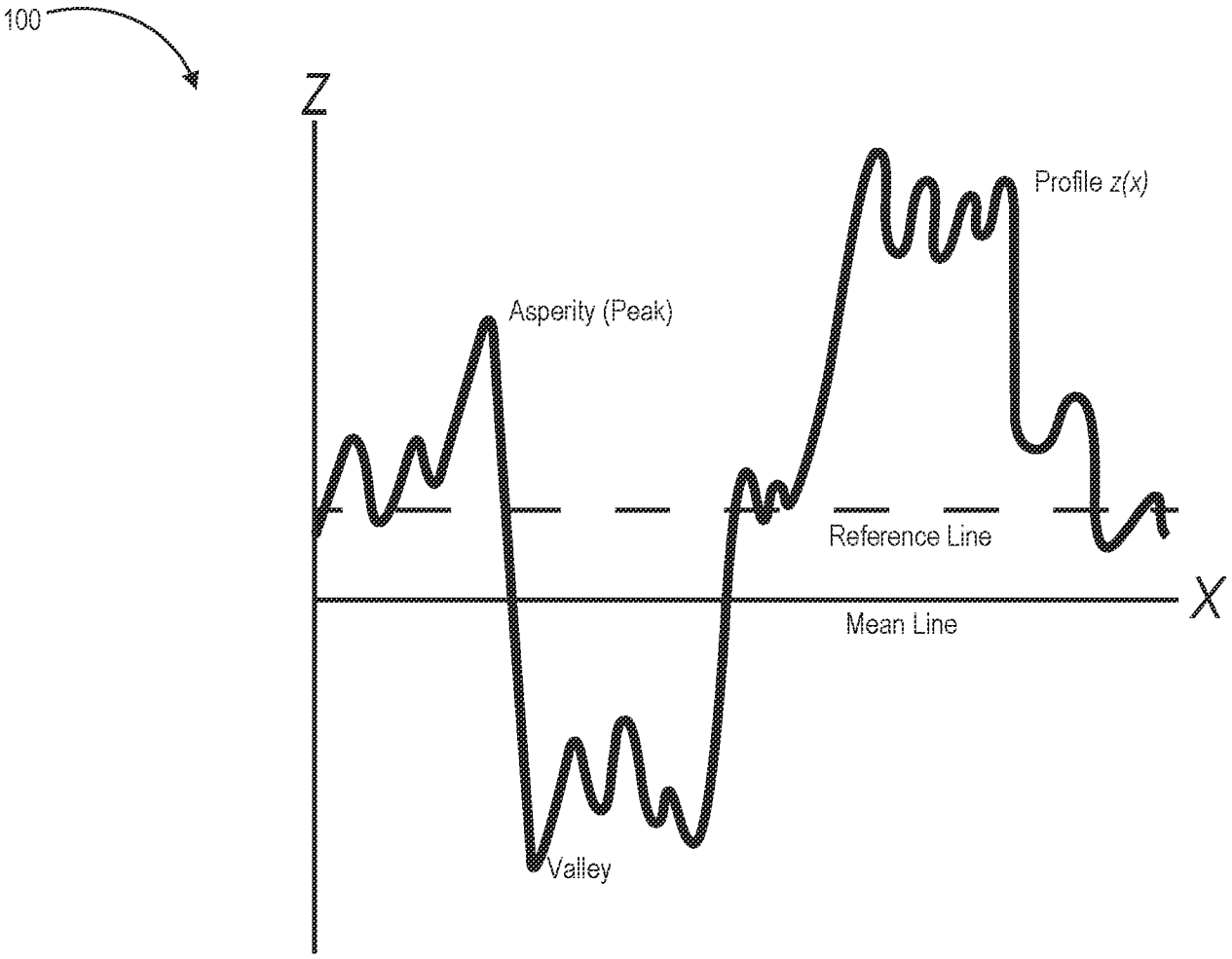
FIG. 6 illustrates a key for interpretation of a surface roughness chart.
Figure 7:
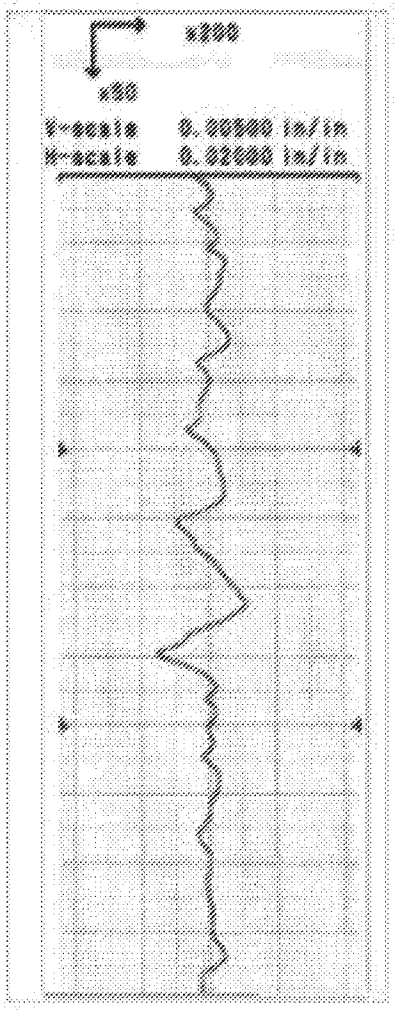
Fig. 7 PRIOR ART
FIG. 7 illustrates a surface roughness chart for an existing modular tile.
Figure 8:
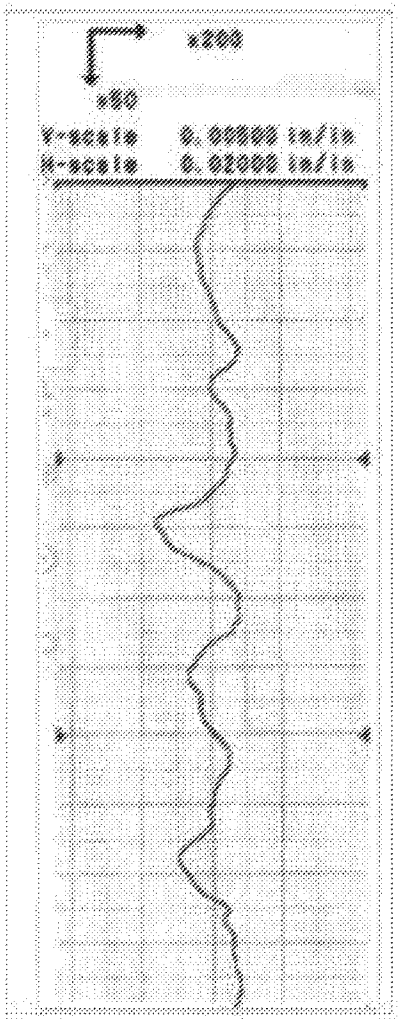
Fig. 8 PRIOR ART
FIG. 8 illustrates a surface roughness chart for another existing modular tile.

FIGS. 6-10 depict graphs showing additional properties and advantages of the synthetic modular tile with improved grip and bounce characteristics as disclosed herein. FIG. 6 shows a reference diagram for the roughness plots that follow in FIG. 7-9. FIGS. 7-8 show the roughness plots for two relatively smooth synthetic tiles. The roughness plot of FIG. 9, for a tile in accordance with aspects of the present invention, shows the increased roughness provided by the characteristics discussed herein.

FIG. 10 shows a chart of testing data comparing the relatively smooth synthetic tiles referenced in FIGS. 7-8, designated by PGT and PGP, compared to an example of a tile according to aspects of the present invention, designated by SGPB. These results show the surface roughness analyses of PGT (or PG), PGP (or PG+), and SGPB (or Pickleball) tiles. "Ra" is widely used as a "roughness" metric, and testing shows that the tile of the present disclosure has the highest Ra value. Also, Rz/Rp/Rv values which are specifically relevant to the height of the highest peaks and the depth of the lowest valleys show that the tile of the present invention has noticeably higher values than the smooth PG and PG+ tiles. This is also apparent in the surface plots of FIGS. 7-9. In addition, based on the Ra value, the surface roughness guideline widely used in various industries would rate the smooth PG and PG+ tiles as N10 Roughness Grade Number, while the tile of the present disclosure achieves a rating of N11.

With further reference to a tile according to aspects of the present technology, the tile may include various types of raw material. Rigid plastic may be used, including thermoplastic polyolefin (e.g. polyethylene, polypropylene or a combination of the two). Flexible rubber may be blended with the rigid plastic, which may include a material blend consisting of thermoplastic, elastomer or rubber, or (TPO, TPE, TPV, EPDM) and optional fillers (e.g. polypropylene+calcium carbonate+ethylene propylene rubber). Proportions typically used for most industrial products can range from 20 plastic and 80 rubber all the way to 90 plastic and 10 rubber. In aspects of the present technology, the tile may be composed of as little as 10% and as much as up to 30% rubber.

The rubber plastic blend provides a number of advantages, including slip resistance, fall protection, reduction of ball skip, ball bounce enhancement, and reduction of dead spots. For example, the table below shows the ball bounce behavior of an Onix outdoor pickleball on a tile according to aspects of the present disclosure, based on the percentage composition of rubber:

| % Rubber in Composition | 0% | 20% | 30% |
|---|---|---|---|
| % bounce | 99.5 | 98.2 | 101.9 |
| Std dev | 0.01 | 0.03 | 0.03 |

The table below shows the ball bounce behavior of an Onix indoor pickleball on the same:

| % Rubber in Composition | 0% | 20% | 30% |
|---|---|---|---|
| % bounce | 97.5 | 98.9 | 99.5 |
| Std dev | 0.02 | 0.03 | 0.03 |

As seen by these numbers, increasing the percentage of rubber in the composition increases the bounce of the ball, as discussed more fully herein.

According to aspects of the present disclosure, the raw formulation of a tile may include:

- between 55% and 85% polypropylene
- between 5% and 15% of reinforcements such as mineral fillers and fibrous additives.
- between 10% and 30% of rubber.

As will be understood, these broad ranges present merely one example of a formulation of material according to the present disclosure.

With respect to reduction of dead spots, the tile of the present disclosure improves upon existing synthetic tiles by way of its rigid plastic and rubber composition. Subsurfaces on top of which modular tiles are installed can always have uneven spots either due to impurities in the concrete or the way it is poured. The Plastic/rubber blend for a tile as discussed herein can better hide the imperfections by conforming to any contour the subsurface has. Because the tile of the present disclosure better conforms to the subsurface, any gap between the tile and the subsurface is decreased or eliminated, leading to less likelihood of "dead spots". As discussed herein, this results in consistent bounce throughout the court for ball sports, including pickleball and tennis.

In other aspects of the invention, further reduction of ball skip may be achieved by applying a rough top surface to the style, including as part of a supplementary post-processing of a tile after it is molded. For example, a surface coating material with suspended sand or grit may provide a roughness that more approximates a traditional acrylic hard court for tennis and pickleball. Other surface coatings, and other post processes that provide additional roughness to the top of the tile, may also be provided to increase the grip of a synthetic modular tile, thereby improving the bounce characteristics for sports including tennis and pickleball.

According to aspects of the invention, a modular tile is configured to interlock with multiple tiles to form a modular floor covering over a floor. The tile includes improved grip and bounce characteristics. The tile may include an upper contact surface having rib with top edges that are sharp. Protrusions may extend from the upper contact surface to provide grip and increase ball bounce performance. The tile may be made of a composite of rigid plastic and rubber to improper bounce characteristics, including by increasing the degree to which the tile conforms with a subfloor.

In aspects of the invention, a modular synthetic floor tile includes a plurality of interconnecting structural members defining an upper contact surface of the floor tile having a plurality of openings. The plurality of structural members includes a contact flat defining a portion of said upper contact surface and having a width between 2.5 and 5.0 mm. In aspects of the invention, the contact flat has a plurality of protrusions and the protrusions extend between 0.01 and 0.10 mm above the upper contact surface.

In some aspects, the modular floor tile includes protrusions having a width between 0.1 and 0.3 mm. In some aspects, the modular floor tile includes protrusions having a length between 0.3 and 1.0 mm.

According to aspects of the present disclosure, the modular floor tile can include at least the upper contact surface being formed from a composition of rigid plastic and rubber. In one aspect, the composition may comprise at least 20% rubber.

The modular floor tile, according to aspects of the present disclosure, may include a radius of a side of the contact flat that is less than 0.005 inches. The modular floor tile may also include protrusions that are formed of the same material as the upper contact surface. In aspects, the protrusions are formed by etching the tooling mold for the tile by either acid etching or laser etching. In other aspects, the protrusions are formed from an additive post-process. For example, the protrusions may include a sand or grit material suspended in an additive coating.

According to some aspects of the present technology, a synthetic floor system may include a plurality of interconnected floor tiles. Each of the floor tile may include one or more contact flat surfaces defining at least a portion of an upper contact surface of the floor tile, each contact flat surface having a width between 2.5 and 5.0 mm. In some aspects, each of the one or more contact flat surfaces may include a plurality of protrusions that extend between 0.01 and 0.10 mm above the upper contact surface.

The synthetic floor system may include protrusions that have a width between 0.1 and 0.3 mm and a length between 0.3 and 1.0 mm. According to aspects of the technology, at least the upper contact surface may be formed from a composition of rigid plastic and rubber. In some aspects, rubber comprises at 20% of the composite. In other aspects, the composite comprises less than 20% rubber. For example, in one aspect, the composite may include 10% rubber, 12% rubber, 15% rubber, or 18% rubber. In yet other aspects, the composite comprises more than 20% rubber, for example 22% rubber, 25% rubber, 28% rubber, 30% rubber or more than 30% rubber.

In aspects, the synthetic floor system of includes a radius on at least one side of the contact flat. In some aspects, the radius is on all exposed sides of the flat. The radius may be less than 0.005 inches, or it may be 0.004 inches or less, 0.003 inches or less or 0.002 inches or less. In other aspects, the radius may be 0.005 inches, or it may be greater than 0.005 inches. The protrusions may be formed of the same material as the upper contact surface. For example, the protrusions may be formed by etching the tooling mold for the tile by either acid etching or laser etching. In other aspects, the protrusions are formed from an additive post-process.

According to some aspects of the present technology, a method for enhancing the performance characteristics of a modular synthetic floor tile is disclosed. The method includes configuring a plurality of interconnecting structural members to define an upper contact surface of the floor tile having a plurality of openings and configuring each of said structural members to comprise a thickness sufficient to support a load about said upper contact surface. In aspects, the upper contact surface includes a contact flat defining a portion of said upper contact surface, said contact flat having a width between 2.5 and 5.0 mm. In some aspects, the contact flat has a sharp radius on both upper edges of the contact flat, or in other words, a radius that is less than 0.005 inches.

In some aspects of the technology, the upper contact surface includes a plurality of protrusions. The protrusions can extend between 0.01 and 0.10 mm above the upper contact surface in some aspects of the invention.

It is noted and emphasized herein that the features and elements of the different embodiments discussed above are related in that any one or more elements from any one or more embodiments may be incorporated into any other embodiment. A such, the present invention is not limited to the tile embodiments specifically discussed and shown in the drawings.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

The invention claimed is:

1. A modular synthetic floor tile comprising:

a plurality of interconnecting structural members defining an upper contact surface of the floor tile having a plurality of openings, said plurality of interconnected structural members comprising a contact flat defining a portion of said upper contact surface and having a width between 2.5 and 5.0 mm, said contact flat having a plurality of protrusions wherein said protrusions extend between 0.01 and 0.10 mm above the upper contact surface; and wherein the upper contact surface is formed from a composition of rigid plastic and rubber, and the contact flat and the plurality of protrusions are unitary;

wherein at least the upper contact surface is formed from a composition comprising at least 20% rubber.

2. The modular floor tile of claim 1, wherein the protrusions have a width between 0.1 and 0.3 mm.

3. The modular floor tile of claim 1, wherein the protrusions have a length between 0.3 and 1.0 mm.

4. The modular floor tile of claim 1, wherein a radius of a side of the contact flat is less than 0.005 inches.

5. The modular floor tile of claim 1, wherein the protrusions are formed of the same material as the upper contact surface.

6. The modular floor tile of claim 5, wherein the protrusions are formed by etching the tooling mold for the tile by either acid etching or laser etching.

7. The modular floor tile of claim 1, wherein the protrusions are formed from an additive post-process.

8. The modular floor tile of claim 6, wherein the protrusions comprise a sand or grit material suspended in an additive coating.

9. The modular floor tile of claim 1, wherein the upper contact surface is configured to elastically deform under load so as to conform to irregularities of an underlying subfloor and reduce dead spots during ball impact.

10. A synthetic floor system, comprising:

a plurality of interconnected floor tiles comprising a composition of rigid plastic and rubber, each floor tile comprising:

one or more contact flat surfaces defining at least a portion of an upper contact surface of the floor tile, each contact flat surface having a width between 2.5 and 5.0 mm, wherein each of the one or more contact flat surfaces comprises a plurality of protrusions that extend between 0.01 and 0.10 mm above the upper contact surface;

wherein at least the upper contact surface is formed from a composition comprising at least 20% rubber.

11. The synthetic floor system of claim 10, wherein the protrusions have a width between 0.1 and 0.3 mm and a length between 0.3 and 1.0 mm.

12. The synthetic floor system of claim 10, wherein a radius of a side of the contact flat is less than 0.005 inches.

13. The synthetic floor system of claim 10, wherein the protrusions are formed of the same material as the upper contact surface.

14. The synthetic floor system of claim 10, wherein the protrusions are formed by etching the tooling mold for the tile by either acid etching or laser etching.

15. The synthetic floor system of claim 10, wherein the protrusions are formed from an additive post-process.

16. A method for enhancing the performance characteristics of a modular synthetic floor tile, said method comprising:

configuring a plurality of interconnecting structural members to define an upper contact surface of the floor tile having a plurality of openings, the upper contact surface comprising a composition of rigid plastic and rubber;

configuring each of said structural members to comprise a thickness sufficient to support a load about said upper contact surface, the upper contact surface comprising:

a contact flat defining a portion of said upper contact surface, said contact flat comprising a width between 2.5 and 5.0 mm;

wherein at least the upper contact surface is formed from a composition comprising at least 20% rubber.

17. The method of claim 16, wherein the upper contact surface further comprises a plurality of protrusions.

18. The method of claim 17, wherein said protrusions extend between 0.01 and 0.10 mm above the upper contact surface.

* * * * *